United States Patent [19]

Obermeier et al.

[11] 3,948,560

[45] Apr. 6, 1976

[54] SEAT HAVING AN ADJUSTABLE BACK

[75] Inventors: Albert Anthony Obermeier, Waterloo; James Edward Thompson, Cedar Falls, both of Iowa

[73] Assignee: Deere & Company, Moline, Ill.

[22] Filed: Mar. 31, 1975

[21] Appl. No.: 563,612

[52] U.S. Cl. ..... 297/355

[51] Int. Cl.[2] ..... B60N 1/02

[58] Field of Search ..... 297/284, 355, 374, 376

[56] References Cited

UNITED STATES PATENTS

| | | | |
|---|---|---|---|
| 3,336,079 | 8/1967 | Radke et al. | 297/357 |
| 3,544,160 | 12/1970 | Karasick | 297/355 |

*Primary Examiner*—James C. Mitchell

[57] ABSTRACT

A seat assembly has a seat frame tiltably supporting a back frame for movement about an axis parallel to the intersection of planes parallel to the seat and back frames, and has an adjusting mechanism for controlling the degree of tilt from a position to the side of and exterior to the seat frame. The adjusting mechanism includes a tilt adjustment slide movable in a channel provided in the side of the seat frame and having a groove therein oblique to the direction of movement of the slide. The slot engages a stud mounted in the back frame and movement of the slide towards and away from the axis of tilt causes the stud to move relative to the channel resulting in movement of the back frame relative to the seat frame.

10 Claims, 2 Drawing Figures

FIG. 2
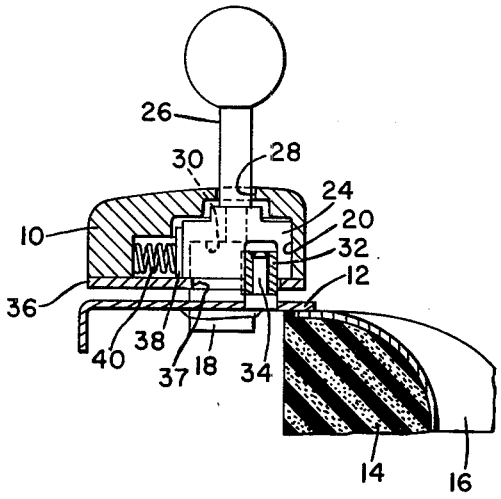
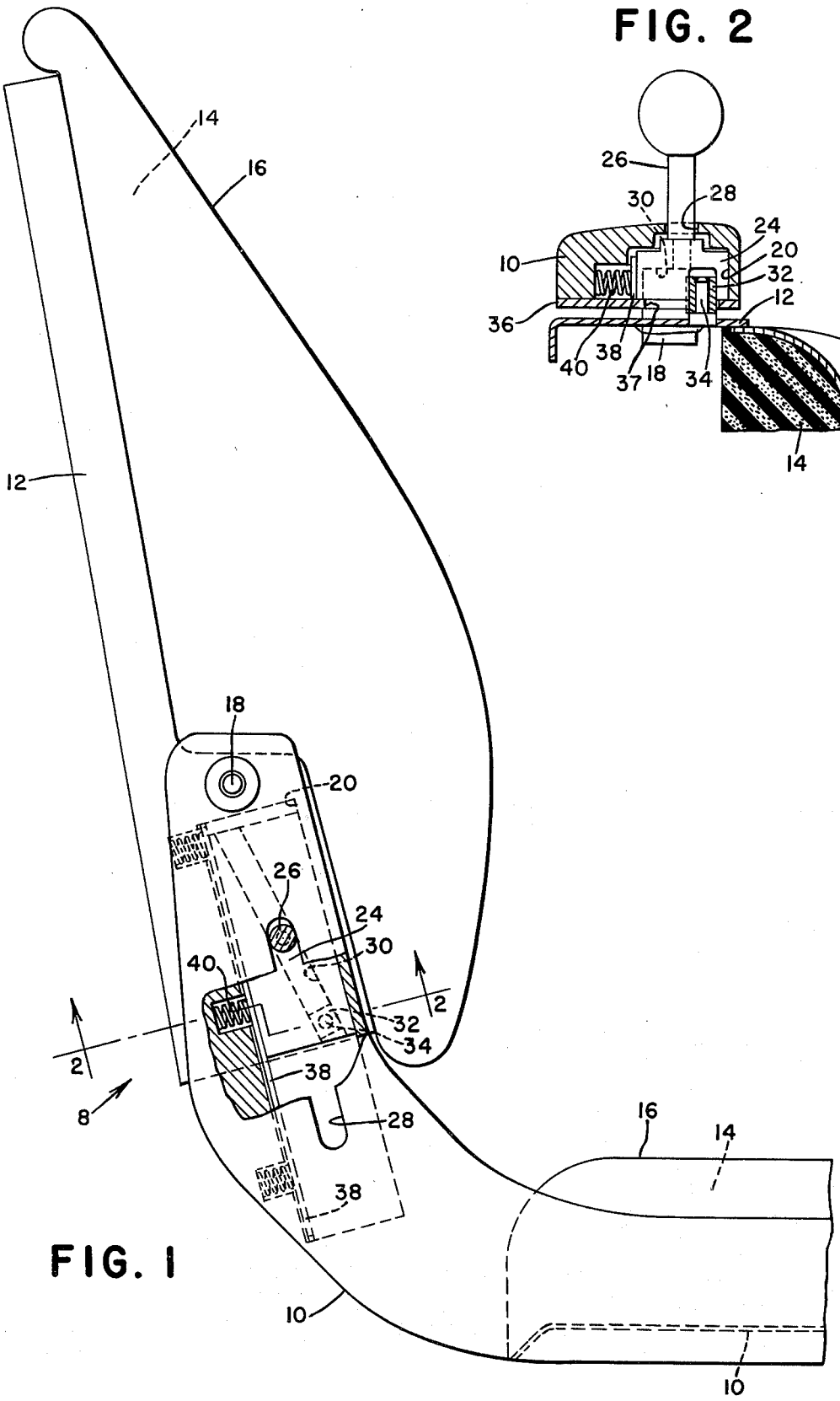
FIG. 1

SEAT HAVING AN ADJUSTABLE BACK

BACKGROUND OF THE INVENTION

The present invention relates generally to adjustable back seats and more particularly relates to seats wherein the amount of adjustment of an easily adjusted control is directly proportional to the degree of tilt of the back.

In the past, seats which were easy to adjust had incremental positions for tilt adjustment of the back while those which had infinitely adjustable tilt adjustments were difficult to adjust. For example, in the U.S. Pat. No. 3,336,079 granted to A. O. Radke et al on Aug. 15, 1967, there is disclosed an infinitely adjustable tilt adjustment which is difficult to adjust because the adjustment must be made transversely to the body of a seated occupant.

SUMMARY OF THE INVENTION

It is a general object of the present invention to provide a seat with a tiltable back wherein the adjustment of an easily adjusted control is perpendicular to a seated occupant, infinitely variable and directly proportional to the degree of tilt of the back.

The above and additional objects and advantages of the present invention will become apparent to those skilled in the art from a consideration of the following detailed description of a preferred embodiment of the invention when taken in conjunction with the accompanying drawings.

BRIEF DESCRIPTION OF THE DRAWINGS

FIG. 1 is a sectioned side view of a seat according to the present invention;

FIG. 2 is a side view taken along line 2—2 of FIG. 1.

DESCRIPTION OF THE PREFERRED EMBODIMENT

Referring now to the drawings, there is shown a seat having a seat frame 10 and a back frame 12. Elastomeric materials 14 are attached to frames 10 and 12 and are restrained by flexible coverings 16. The seat and the back frames 10 and 12 are connected by pivot pins 18 (only one shown) which define an axis of pivotation parallel to the intersection of planes parallel to the seat and the back frames. Movement of the back frame 12 about the axis defined by pins 18 is controlled by an adjusting mechanism generally shown at 8.

The seat frame 10 includes a slide channel 20, generally on the right hand side of a seated occupant and perpendicular to the axis of pivotation, and a tilt adjustment slide 24 positioned therein for sliding movement perpendicular to the axis of pivotation. The slide 24 may be of any material but is preferably of a dimensionally temperature-stable, low coefficient of friction plastic. A lever 26 is secured to the slide 24 and protrudes exterior to the seat through a slot 28 provided in the frame 10 so that an occupant of the seat, by movement of the lever 26 along the slot 28, can move the slide 24 along the length of the channel 20.

The slide 24 further has a substantially diagonal, open-ended groove 30 oblique to the channel 20. The groove 30 receives a square bushing 32 mounted over a stud 34 carried by the back frame 12. A cover plate 36 having a stud clearing aperture 37 is secured to and retains the slide 24 in the seat frame 10.

A pressure plate 38, loaded by springs 40, is positioned between the slide 24 and one wall of the channel 20 and urges the slide 24 against the far wall so that the slide 24 will be frictionally held in any position. The springs 40 are chosen so as to reach the best compromise between maximum frictional holding force and minimum effort required to move the slide 24.

In operation, the seat occupant reaches back and moves the lever 26 perpendicular to and away from the pivot pin 18 to move the top of the back forward and perpendicular to and towards the pivot pin 18 to move the top of the back backward. Since adjustments are made in line with natural arm actions of the seated occupant, adjustments can be easily made with a minimum amount of effort.

As the forward tilt adjustment is made, the downward movement of the slide 24 in the channel 20 causes a wedging action by the slide 24 between the stud 34 and a wall of the groove 30 forcing the stud 34 backwards and thus moving the top of the back frame 12 forward. Likewise, when the rearward tilt adjustment is made, the stud 34 is wedged by the slide 24 against the other wall of the groove 30 and is forced forward, causing the top of the back frame 12 to tilt backward about the pivot pin 18. The amount of tilt about the pivot pin 18 is approximately 10° and is directly proportional to the range of travel of the lever 26 in the slot 28.

Once the desired position is reached, the occupant releases the lever 26. The springs 40 and the pressure plate 38 acting against the slide 24 hold it in the desired position even when the occupant of the seat leans back and applies force between the seat frame 10 and the back frame 12.

While the invention has been described in conjunction with a specific embodiment, it is to be understood that many alternatives, modifications, and variations will be apparent to those skilled in the art in light of the foregoing description. Accordingly, it is intended to embrace all such alternatives, modifications, and variations that fall within the spirit and scope of the appended claims.

We claim:

1. A seat having an adjustable back, comprising: a back portion; a seat portion pivotally supporting the back portion and having a channel therein perpendicular to the axis of pivotation; a tilt adjustment slide positioned in the channel for reciprocating sliding therein perpendicular to the axis of pivotation; said tilt adjustment slide having a groove therein oblique to the channel; manually operable means for causing sliding of the slide in the channel; and engaging means carried by the back portion and engaging the groove for sliding movement therein and pivotal movement relative to the channel in response to movement of the slide whereby the back portion is moved relative to the seat portion.

2. The invention as claimed in claim 1 wherein the channel is substantially vertical.

3. The invention as claimed in claim 1 wherein a major dimension of the channel extends radially outward from the axis of pivotation.

4. The invention as claimed in claim 1 including loading means operatively associated with the slide for urging the slide to one side of the channel so that the slide will be held in place by frictional forces.

5. The invention as claimed in claim 4 wherein the loading means includes a pressure plate extending substantially the length of the channel and interposed between the slide and the other side of the channel, and spring means for urging the pressure plate towards the one side of the channel.

6. A seat having an adjustable back, comprising: a back frame; a seat frame pivotally supporting the back frame for pivotal movement about an axis of pivotation parallel to the intersection of planes parallel to the seat and back frames; said seat frame having a channel therein perpendicular to the axis of pivotation; a tilt adjustment slide slidably inserted in the channel for reciprocating sliding therein perpendicular to and towards and away from the axis of pivotation; said tilt adjustment slide having a groove therein oblique to the channel; a handle attached to the slide for causing sliding movement of the slide in the channel; and a stud parallel to the axis of pivotation carried by the back frame and engaging the groove for sliding movement therein and pivotal movement relative to the channel in response to the reciprocating sliding of the slide whereby the back frame is moved relative to the seat frame.

7. The invention as claimed in claim 6 wherein the channel is substantially vertical.

8. The invention as claimed in claim 6 wherein the axis of pivotation is above the channel and a major dimension of the channel extends radially outward from the axis of pivotation.

9. The invention as claimed in claim 6 including loading means for urging the slide to one side of the channel so that the slide will be held in place by frictional forces.

10. The invention as claimed in claim 9 wherein the loading means includes a pressure plate extending substantially the length of the channel and interposed between the slide and the other side of the channel, and spring means for urging the pressure plate towards the one side of the channel.

* * * * *